US005642932A

United States Patent [19]

Matthews

[11] Patent Number: 5,642,932

[45] Date of Patent: Jul. 1, 1997

[54] COMBAT-ORIENTED FLASHLIGHT

[75] Inventor: John Wallace Matthews, Corona del Mar, Calif.

[73] Assignee: Laser Products Corporation, Fountain Valley, Calif.

[21] Appl. No.: 361,755

[22] Filed: Dec. 22, 1994

[51] Int. Cl.[6] ..... F21L 7/00

[52] U.S. Cl. ..... 362/206; 362/202

[58] Field of Search ..... 362/206, 118, 362/119, 120, 202, 203, 204, 205, 190, 191

[56] References Cited

U.S. PATENT DOCUMENTS

| | | | |
|---|---|---|---|
| Re. 29,047 | 11/1976 | Brindley . | |
| D. 263,170 | 2/1982 | Maglica | D26/49 |
| D. 297,828 | 9/1988 | Bromley | D13/6 |
| D. 298,748 | 11/1988 | Sharrah | D13/6 |
| D. 303,107 | 8/1989 | Maglica | D13/6 |
| D. 306,492 | 3/1990 | Sharrah | D26/49 |
| D. 307,488 | 4/1990 | Sharrah | D26/49 |
| D. 308,109 | 5/1990 | Maglica | D26/49 |
| D. 310,425 | 9/1990 | Sharrah | D26/49 |
| D. 312,509 | 11/1990 | Sharrah | D26/49 |
| D. 324,430 | 3/1992 | Sharrah | D26/46 |
| 1,149,705 | 8/1915 | Ward . | |
| 1,403,538 | 1/1922 | Burgess . | |
| 1,433,570 | 10/1922 | Stimson . | |
| 1,603,272 | 10/1926 | Eaton . | |
| 1,661,784 | 3/1928 | Blake . | |
| 1,669,292 | 5/1928 | Eckstein . | |
| 1,671,623 | 5/1928 | Barany . | |
| 1,674,650 | 6/1928 | Leser . | |
| 1,680,169 | 8/1928 | Osean . | |
| 1,680,188 | 8/1928 | Weber . | |
| 1,769,241 | 7/1930 | Stephani | 362/202 X |
| 1,781,064 | 11/1930 | Jones . | |
| 1,823,762 | 9/1931 | Rathmann . | |
| 1,955,511 | 4/1934 | Muros . | |
| 2,016,819 | 10/1935 | Meginniss . | |
| 2,020,352 | 11/1935 | Bolduc . | |
| 2,097,222 | 10/1937 | Tompkins . | |
| 2,125,038 | 7/1938 | Tompkins et al. . | |
| 2,176,084 | 10/1939 | Lennan . | |
| 2,225,936 | 12/1940 | Williams . | |
| 2,259,106 | 10/1941 | Hager . | |
| 2,338,078 | 12/1943 | Wood . | |
| 2,339,356 | 1/1944 | Sachs . | |
| 2,385,639 | 9/1945 | Packer et al. . | |
| 2,439,496 | 4/1948 | Szantay . | |
| 2,461,118 | 2/1949 | Lippincott . | |
| 2,490,830 | 12/1949 | Norton . | |
| 2,503,287 | 4/1950 | Moore . | |
| 2,518,437 | 8/1950 | Amstutz . | |
| 2,520,023 | 8/1950 | Allen . | |
| 2,530,913 | 11/1950 | Shackel . | |

(List continued on next page.)

FOREIGN PATENT DOCUMENTS

| | | |
|---|---|---|
| 138873 | 4/1948 | Australia . |
| 1271830 | 8/1961 | France . |
| 1430456 | 1/1966 | France . |
| 2372382 | 6/1978 | France . |
| 411218 | 6/1934 | United Kingdom . |
| 555910 | 9/1943 | United Kingdom . |
| 586357 | 3/1947 | United Kingdom . |
| 752619 | 7/1956 | United Kingdom . |
| 812980 | 5/1959 | United Kingdom . |
| 884212 | 12/1961 | United Kingdom . |
| WO94/13022 | 6/1994 | WIPO . |

*Primary Examiner*—Ira S. Lazarus
*Assistant Examiner*—Thomas M. Sember
*Attorney, Agent, or Firm*—Benoit Law Corporation

[57] ABSTRACT

Flashlights are provided with a mode of operation enabling switching at a thumb area of a human hand while retaining that flashlight with fingers of that human hand during switching of that flashlight at that thumb area. The flashlight has a battery barrel provided with a tail-end switch. That battery barrel is also provided with a reduced diameter portion spaced from that tail-end switch, and with a retention element projecting from that reduced diameter portion for engagement by at least one of the fingers of the human hand during switching of the flashlight at the thumb area.

51 Claims, 2 Drawing Sheets

U.S. PATENT DOCUMENTS 2,599,295 6/1952 Thomas .
2,769,896 11/1956 Lambert .
2,797,309 6/1957 Dulberg .
2,830,280 4/1958 Webber .
2,852,632 9/1958 Garland .
2,852,633 9/1958 Garland .
2,876,410 3/1959 Fry .
2,897,345 7/1959 Meager et al. .
2,915,621 12/1959 Garland .
2,931,005 3/1960 Saurwein et al. .
2,945,944 7/1960 Gillespie .
3,014,125 12/1961 Draudt .
3,226,538 12/1965 Bustamante .
3,250,911 5/1966 Oldenburger .
3,521,050 7/1970 Shagena, Jr. .
3,701,862 10/1972 Vignini .
3,717,759 2/1973 Rousseau .
3,798,440 3/1974 Brindley .
3,825,740 7/1974 Friedman et al. .
3,835,272 9/1974 Wisenbaker .
3,924,116 12/1975 Brindley .
3,924,117 12/1975 Brindley .
4,092,580 5/1978 Prinsze .
4,135,230 1/1979 Armbruster ..... 362/206
4,151,583 4/1979 Miller ..... 362/205
4,171,534 10/1979 Strowe ..... 362/183
4,203,150 5/1980 Shamlian ..... 362/183
4,234,913 11/1980 Ramme ..... 362/158
4,244,011 1/1981 Hammel et al. ..... 362/183
4,261,026 4/1981 Bolha ..... 362/101
4,281,368 7/1981 Humbert ..... 362/100
4,286,311 8/1981 Maglica ..... 362/205
4,288,891 9/1981 Boden .
4,313,272 2/1982 Matthews .
4,327,401 4/1982 Siiberg ..... 362/183
4,329,740 5/1982 Colvin ..... 362/184
4,345,304 8/1982 Penney et al. ..... 362/183
4,357,648 11/1982 Nelson ..... 362/183
4,388,673 6/1983 Maglica ..... 362/183
4,398,139 8/1983 Prinsze .
4,398,238 8/1983 Nelson ..... 362/187
4,429,351 1/1984 Petzl et al. ..... 362/187
4,441,142 4/1984 Garofalo ..... 362/158
4,463,283 7/1984 Penney et al. ..... 315/87
4,472,766 9/1984 Hung ..... 362/158
4,495,551 1/1985 Foltz ..... 362/205
4,502,102 2/1985 Phipps ..... 362/183
4,514,790 4/1985 Will ..... 362/187
4,527,223 7/1985 Maglica ..... 362/187
4,530,034 7/1985 Kawarada ..... 362/9
4,531,178 7/1985 Uke ..... 362/158
4,577,263 3/1986 Maglica ..... 362/187
4,581,686 4/1986 Nelson ..... 362/204
4,605,993 8/1986 Zelina, Jr. ..... 362/183
4,609,976 9/1986 Geissler ..... 362/202
4,640,258 2/1987 Penney et al. ..... 124/24
4,656,565 4/1987 Maglica ..... 362/187
4,658,336 4/1987 Maglica ..... 362/197
4,704,663 11/1987 Ohashi ..... 362/202 X
4,725,932 2/1988 Gammache ..... 362/202
4,733,337 3/1988 Bieberstein ..... 362/206
4,737,894 4/1988 Kuds et al. ..... 362/118
4,760,504 7/1988 Schaller ..... 362/205
4,777,582 10/1988 Sharrah ..... 362/205
4,788,633 11/1988 Zimmermann ..... 362/296
4,803,605 2/1989 Schaller ..... 362/184
4,819,141 4/1989 Maglica ..... 362/207
4,823,242 4/1989 Maglica ..... 362/187
4,825,345 4/1989 Stevens ..... 362/183
4,841,417 6/1989 Maglica ..... 362/206
4,843,298 6/1989 Brauch .
4,851,974 7/1989 Maglica ..... 362/187
4,864,474 9/1989 Maglica ..... 362/203
4,876,416 10/1989 Frantz .
4,885,668 12/1989 Maglica ..... 362/345
4,888,670 12/1989 Sharrah ..... 362/205
4,899,265 2/1990 Maglica ..... 362/187
4,914,555 4/1990 Gammache ..... 362/183
4,942,505 7/1990 Maglica ..... 362/187
4,956,755 9/1990 Maglica ..... 362/206
5,003,440 3/1991 Maglica ..... 362/158
5,008,785 4/1991 Maglica ..... 362/183
5,113,326 5/1992 Maglica ..... 362/158
5,121,308 6/1992 Maglica ..... 362/187
5,143,441 9/1992 Maglica ..... 362/263
5,158,358 10/1992 Maglica ..... 362/206
5,161,095 11/1992 Gammache ..... 362/197
5,171,086 12/1992 Baloochi ..... 362/188
5,345,370 9/1994 Murray et al. ..... 362/202 X
5,406,735 4/1995 Howell ..... 43/17.5
5,422,798 6/1995 Osiecki et al. ..... 362/206

COMBAT-ORIENTED FLASHLIGHT

FIELD OF THE INVENTION

The subject invention relates to battery-powered apparatus and, more specifically, to flashlights, including flashlights suited to use in special or dangerous situations or environments, and to light-beam assisted firearm systems.

BACKGROUND OF THE INVENTION

Since the start of World War I, people have been trying to assist crime fighters with flashlights on their weapons, as may for instance be seem from U.S. Pat. No. 1,149,705, by Eugene S. Ward, issued Aug. 10, 1915 for a Search Light for Firearms.

By contrast, a very sophisticated aiming and target illumination system is seen from U.S. Pat. No. 4,313,272, by John W. Matthews, Ph.D., issued to Laser Products Corporation on Feb. 2, 1982, for Laser Beam Firearm Aim Assisting Methods and Apparatus.

On the more popular level, techniques have developed for the use of hand-held flashlights with firearms.

One such technique has become known as "the Harries technique" that involves holding a handgun with one hand (the "gun hand"), while holding a flashlight with the other hand (the "flashlight hand"), and crossing the "flashlight hand" under the wrist of the "gun hand" for illumination of the target and stabilization of the "gun hand."

Another emerging technique is called "the Rodgers technique" after firearm trainer Bill Rodgers. That Rodgers technique holds the flashlight between the index and middle fingers of the "flashlight hand" and activates the flashlight through an electric tail-end switch which is pressed against the ball of the thumb for illumination of the target, while that "flashlight hand" also steadies the "gun hand."

In order to practise that Rodgers technique, people have put a bicycle innertube over the battery barrel and have used various rubberbands around such barrel in an effort to increase friction and grip by human fingers.

SUMMARY OF THE INVENTION

The invention resides in a method of providing a flashlight including an elongate battery barrel having a front end and a tail end opposite that front end, with a mode of operation enabling switching of that flashlight at a thumb area of a human hand while retaining that flashlight with fingers of that human hand during switching of that flashlight at that thumb area, and, more specifically, resides in the improvement comprising, in combination, locating at the front end of the elongate battery barrel a lamp assembly including a lamp and lamp reflector pointing longitudinally away from the elongate a battery barrel, providing that battery barrel at its tail end with a tail-end switch for that flashlight, providing that battery barrel with a reduced diameter portion spaced from that tail-end switch, and providing that battery barrel with a retention element projecting from that reduced diameter portion for retention between two adjacent ones to fingers of the human hand during switching of said flashlight at that thumb area.

The invention resides also in a flashlight including the improvement comprising, in combination, an elongate battery barrel having a front end and a tail end opposite that front end, a lamp assembly located at that front end of the elongate battery barrel and including a lamp and lamp reflector pointing longitudinally away from that elongate battery barrel, a tail-end switch for that flashlight on that battery barrel at the tail end and electrically connectible to the lamp, a reduced diameter portion on that battery barrel spaced from that tail-end switch, and a retention element projecting from that reduced diameter portion and adapted for retention of the flashlight between two adjacent fingers of the human hand during switching of that flashlight with the tail-end switch at the thumb area.

Features of such method and apparatus according to various aspects of the invention include either alternatively or in combination, projecting the retention element beyond a maximum lateral dimension of the barrel; rendering the flashlight adaptable to various human hand sizes by rendering the retention element adjustable in position on the reduced diameter portion of the barrel relative to the tail-end switch; providing the battery barrel with a retention shoulder between its reduced diameter portion and the tail-end switch; retaining the retention element with that shoulder; and/or providing the reduced diameter portion on the barrel in an axial direction of that barrel with a length at least equal to the width of a human finger, for retention of that reduced diameter portion between two adjacent fingers of the human hand.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figure 1:
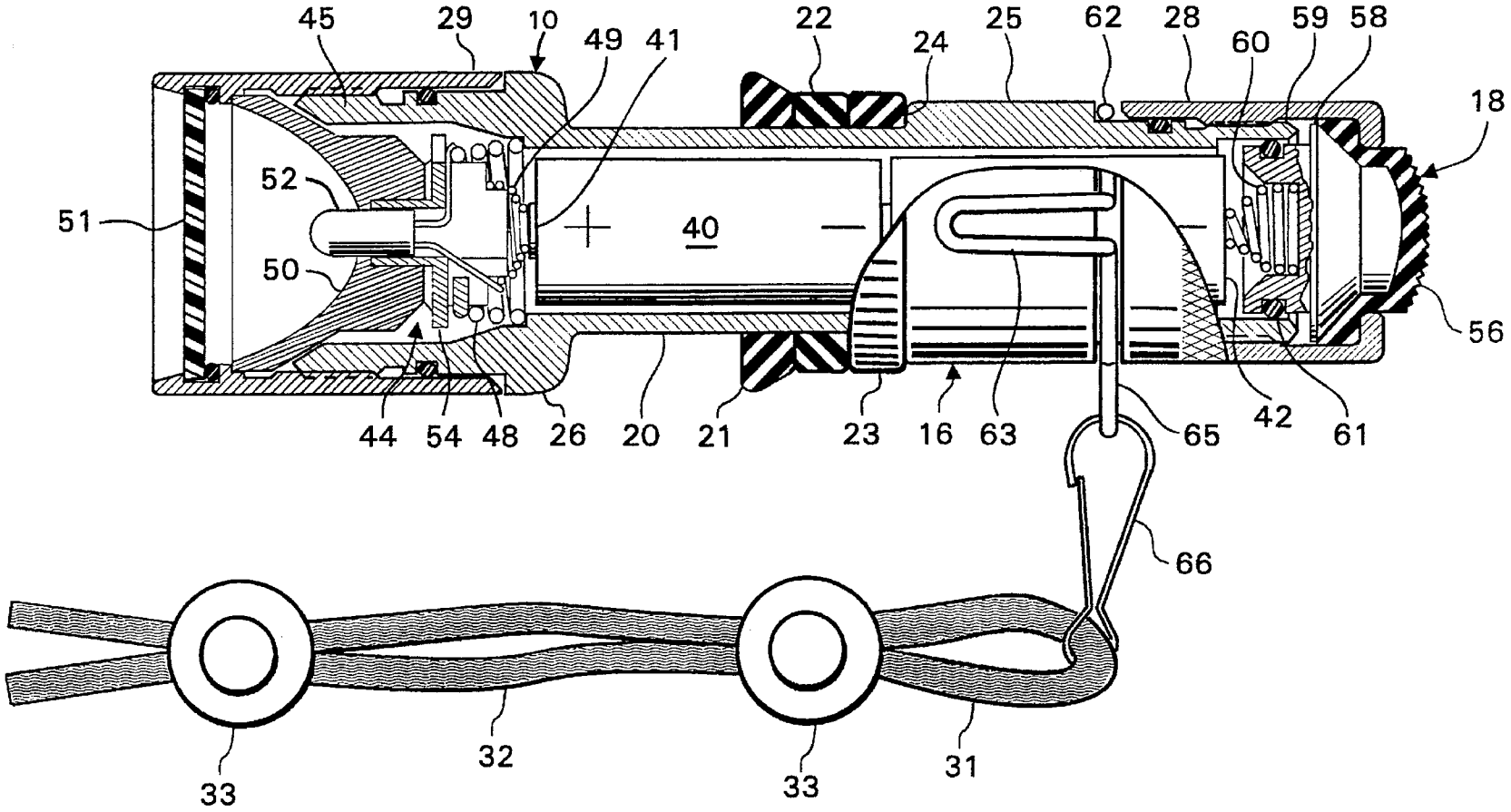
FIG. 1 is a longitudinal section through a flashlight according to a preferred embodiment of invention.

In addition to providing written descriptions of the invention of their own, the accompaning drawings illustrate a flashlight according to a preferred embodiment of the invention and a method of providing a flashlight with a mode of operation enabling switching of such flashlight 10 at a thumb area 12 of a human hand while retaining the flashlight with fingers 13 of that human hand 14 during switching of such flashlight at the thumb area 12. The expression "thumb area" as herein employed is intended to be construed broadly, covering not only the thumb 15 itself, but also the so-called "ball of the thumb," a familiar dictionary definition of which is "the rounded eminence by which the base of the thumb is continuous with the palm of the hand."

The invention provides the flashlight 10 with a battery barrel 16 and provides such battery barrel with a tail-end switch 18 for that flashlight. The illustrated preferred embodiment of the invention provides the battery barrel with a reduced diameter portion 20 spaced from the tail-end switch 18 and provides such battery barrel with a retention element 21 projecting from that reduced diameter portion 20 for retention between two adjacent fingers 13 of the human hand 14 during switching of the flashlight 10 at the thumb area 12 or tail end switch 18.

In structural terms, illustrated embodiments of the invention comprise a battery barrel 16, a tail-end switch 18 for the flashlight 10 on the battery barrel, a reduced diameter portion 20 on that battery barrel spaced from the tail-end switch, and a retention element 21 projecting from that reduced diameter portion and adapted for retention of the flashlight between two adjacent fingers 13 of the human hand during switching of the flashlight with the tail-end switch 18 at the thumb area 12.

As seen in the drawings, the flashlight 10 includes an elongate battery barrel 16 having a front end at 26 and a tail end 59 opposite that front end, and a lamp assembly 44 located at the front end 26 of the elongate battery barrel 16 and including a lamp 52 and lamp reflector 50 pointing longitudinally away from the elongate battery barrel 16, as specifically seen in FIG. 1. The battery barrel 16 is provided at its tail end 59 with the tail-end switch 18 for the flashlight 10. Such tail-end switch 18 for the flashlight on the battery barrel 16 thus is at the tail end 59 and electrically connectible to the lamp 52, such as more fully described below.

According to an embodiment of the invention, the flashlight 10 is made adaptable to various human hand sizes by rendering the retention element 21 adjustable in position on the reduced diameter portion 20 relative to the tail-end switch 18. By way of example, the retention element 21 may be shifted away from the tail end switch 18 for users with large hands. Conversely, the retention element may be shifted closer to that tail end switch for users with small hands.

According to an embodiment of the invention, the retention element is adjustable in position on the reduced diameter portion 20 in discrete steps relative to the tail-end switch 18, such as indicated at 21, 22, 23 more fully described below.

The battery barrel 16 is provided with a shoulder 24 between the reduced diameter portion 20 and the tail-end switch 18. That shoulder may, for instance, be the beginning, at the reduced diameter portion 20, of an increased diameter portion 25 of the barrel between that reduced diameter portion and the tail end switch. Within the scope of the invention, that shoulder 24 may qualify as the retention element and in a simple embodiment may indeed, perform the function of the retention element 21.

The retention element 21 preferably is retained or is adapted for retention at or at least with the shoulder 24. The retention element 21 preferably extends around the reduced diameter portion 20 and is axially retained in place, or is adapted for axial retention, by the shoulder 24.

According to the illustrated embodiment of the invention, the flashlight is rendered adaptable to typical human hand sizes by providing the reduced diameter portion 20 with removable spacer elements 22 and 23 between the retention element 21 and the shoulder 24 of the battery barrel. As shown in FIG. 1, the retention element 21 and the spacer elements 22 and 23 may be of rubber or of another elastomeric material, so that they can be worked over the thickened portion 25 of the barrel 16. On the other hand, solid spacers may be used if the barrel is for instance made in two pieces so that the reduced and enlarged diameter portions 20 and 25 or 26 can be temporarily separated from each other and then reassembled, or if such enlarged diameter portions are in effect provided by a lengthened tail end cap 28 or lamp housing 29.

In the illustrated embodiments of the invention, the retention element 21 is projected beyond a maximum lateral dimension of the barrel 16, such as beyond the maximum diameter of the barrel at its thickened portion 25. For one thing, this improves the grip of the human hand on the improved flashlight 10.

Figure 2:
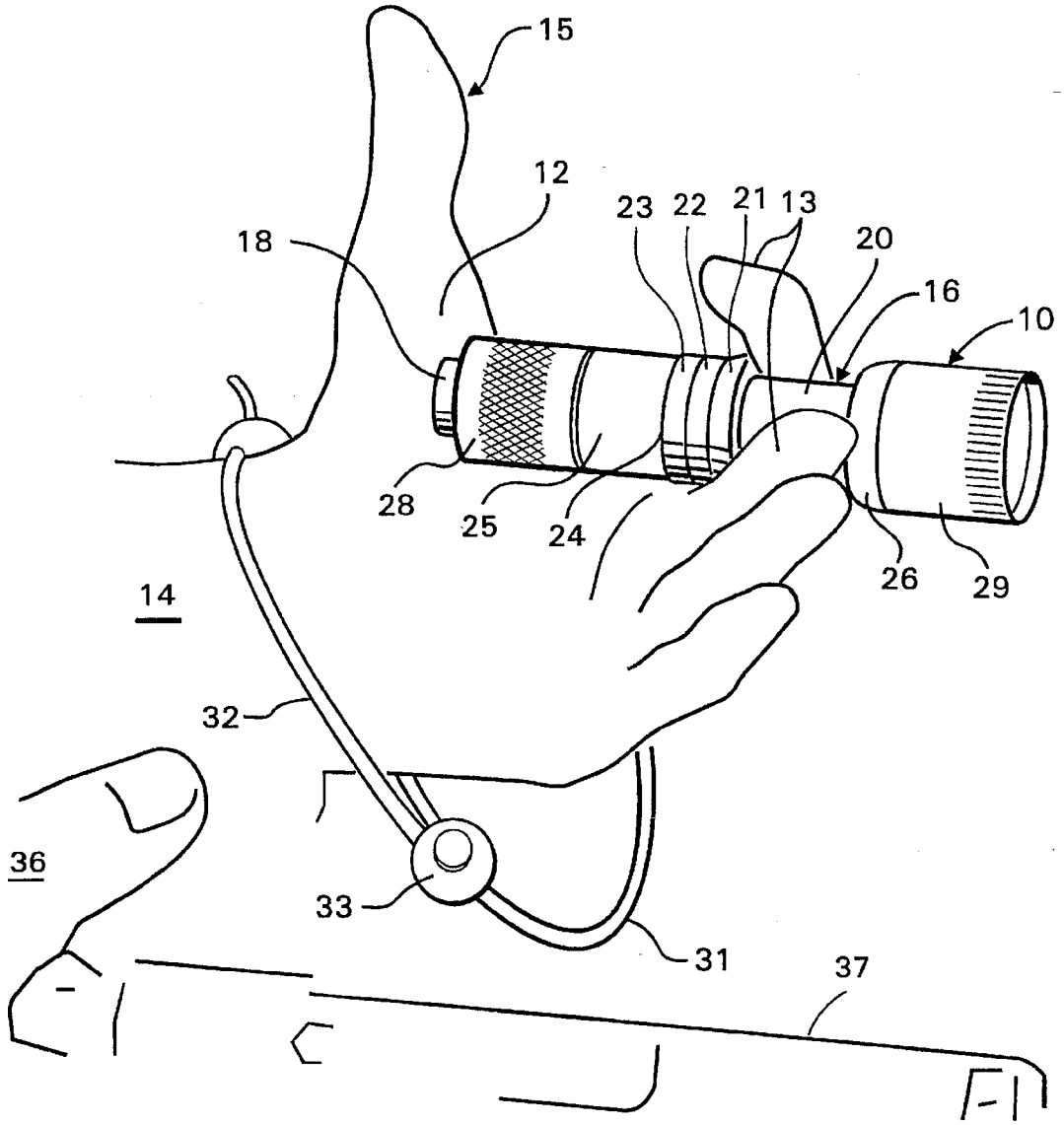
FIG. 2 is a perspective illustration of a flashlight and its handling by a human hand according to an embodiment of the invention, and a schematic view of part of the other hand and of a hand gun handled by the same person.

As seen in FIG. 2 the reduced diameter portion 20 on the barrel has in an axial direction of that barrel 16 a length at least equal to the width of a human finger 13, such as for retention of that reduced diameter portion between two adjacent fingers of the human hand 14. The retention element preferably extends substantially perpendicularly to the reduced diameter portion between that reduced diameter portion 20 and the tail switch 18.

According to an embodiment of the invention, the reduced diameter portion 20 is dimensioned for retention, or is otherwise adapted to be held, between two adjacent fingers 13 of a human hand 14 and the retention element 21 is adapted to be engaged by these two fingers during switching of the flashlight at the thumb area 12 via tail end switch 18.

Handling of the flashlight 10 may be improved by means of a lanyard 31 attached to the barrel 16 between its reduced diameter portion 20 and the tail-end switch 18. The lanyard 31 may include a loop 32 that may be tied around the wrist of the human hand 14, such as with the aid of one or two adjustable cord locks 33. By way of example, a suitable cord lock, which has a depressable plunger for adjustment purposes along the lanyard, has been disclosed in U.S. Pat. No. 4,288,891, by Ogden W. Boden, issued Sep. 15, 1981, and herewith incorporated by reference herein.

Alternatively, the lanyard or loop 32 may be tied around the neck of an athlete or other person.

Both the above mentioned Harries technique and the Rodgers technique may be practiced with flashlights according to the subject invention. In this respect, FIG. 2 shows part of a gun or other weapon 37 that may be held or handled with one hand 36, while the flashlight 10 is held and handled with the other hand 14.

Flashlights according to embodiments of the invention comprise or use a battery 40 having spaced first and second battery terminals 41 and 42, such as shown in FIG. 1. The expression "battery" may refer to a single cell and to an assembly of two or more cells having a common terminal 41, in addition to the opposite terminal 42.

The illustrated flashlight 10 comprises a lamp assembly 44 having the lamp housing or bezel 29 threaded on an end portion or projection 45 of the battery barrel 16. Within the scope of the invention, the lamp assembly 44 may be mounted on the battery barrel by means other than threading.

The lamp assembly 44 has spaced first and second lamp terminals 48 and 49 adapted to contact the battery barrel 16 and the battery terminal 41, respectively. Terminal springs 48 and 49 may act like shock-absorbers, guarding the lamp against shock loads and against impact from a shifting battery.

The lamp assembly 44 may include a lamp reflector 50 releasably retained by the threaded bezel 29. A plastic disc or other transparent lens or member 51 protects the flashlight bulb 52 and reflector 50.

The bulb 52 preferably includes an incandescent filament (not shown) connected between lamp terminals or springs 48 and 49 for energization through battery terminals 41 and 42 when the tail-end switch 18 is depressed.

The springs 48 and 49 may be held in a piece of ceramic or other electrically insulating material or retainer 54 which may also mount the lamp or bulb 52.

At least the embodiment shown in FIG. 1 includes a flexible diaphragm 56 across an end of the threaded tail cap 28. Within the scope of the invention, such diaphragm may be depressible against or toward the battery 40 in the barrel 16 for some kind of switching of the lamp 52 upon depression and relaxation of the flexible diaphragm 56.

The switching function of the flashlight thus is not limited to any particular kind of electrical or mechanical switching mechanism. However, in the embodiment shown in FIG. 1 the tail-end switch 18 includes a plunger 58 capable of contacting an end portion 59 of the barrel 16. A spring 60 at the battery terminal 42 biases the plunger 58 away from the barrel end 59. No electric current can then flow from the battery to the lamp 52, inasmuch as the plunger 58 is also electrically insulated from the barrel 16 by an elastic O-ring 61, and inasmuch as the tail end cap 28 either is of electrically insulating material or is electrically insulated from the battery barrel 16, such as by anodizing the threads between the tail end cap 28 and barrel 16 at 59.

However, upon depression of the plunger 58 against the bias of battery terminal spring 60, such as by inward depression of the diaphragm 56, if present, the plunger 58 contacts the barrel end 59, thereby closing an electrical circuit from the rear battery terminal 42, battery terminal spring 60, electrically conducting plunger 58, rear barrel end 59, electrically conducting barrel or other electrical conductor through barrel 16, first lamp assembly terminal spring 48, lamp 52, second lamp assembly terminal spring 49, front battery terminal 41, whereby the lamp 52 is lit by electric energy from the battery 40.

Pursuant to a preferred embodiment of invention, the diaphragm switching feature is combined with a rotary or translatory switching feature. For instance, the tail cap 28 may be rotated or otherwise moved relative to the barrel 16 until the lamp 52 is at the point of being lit, except for the existence of a small gap between the plunger 58 and barrel end contact 59. The lamp or flashlight may then be lit by a relatively small depression of the flexible diaphragm 56 or other actuation of the plunger 58, such as by a finger, thumb or thumb area 12.

In practice, the travel of the diaphragm 56 or plunger 58 required for actuation of the flashlight, or the "touch" of the flashlight so to speak, is then easily adjusted for different persons and preferences by preliminary rotary or other motion of the tail cap 28 relative to the barrel 16.

For added convenience, or independently of these features, the lanyard 31 may be attached to the flashlight barrel between the enlarged diameter portion 25 and the tail cap 28, such as by means of a rotatable ring structure 62 that may have loop 63 extending substantially parallel to the battery barrel 16 at a space thereto, or spaced therefrom, for retention of the flashlight 10 at a person's belt, shirt pocket, trouser pocket or holster, etc.

The ring structure 62 also has a radially extending loop 65 for attachment of the lanyard 31. A spring snap hook or clip 66 may be used for releasably attaching the lanyard 31 to the flashlight 10 or barrel 16.

The flashlight 10 is very handy and is immune to the kind of wear, tear and defect that affects prior-art flashlights equipped with conventional "on-off" sliding switches.

The flashlight 10 can be clenched in a person's fist, with the person's fingers extending around part of the circumference of the barrel 16 and the person's thumb 15 being then in a position to activate the flashlight by depression of the end switch 18, such as by inward depression of the diaphragm 56 or plunger 58.

In this manner, the user can forcefully hold and activate the flashlight. For instance, the user can hold the flashlight with clenched fingers at a side of his or her head and can then activate the flashlight with his or her thumb so that it shines into the dark ahead of his or her head without blinding his or her eyes. A user thus can shine the flashlight forcefully and effectively into an attacker's eyes, stunning him and prompting him to go elsewhere.

By way of further example, a user can walk with the flashlight 10 clenched in his or her fingers and with the light beam pointing downwardly to illuminate his or her path. The user can easily activate and deactivate the light beam with his or her thumb while walking. Moreover, a driver or passenger in an automobile or other vehicle can use the flashlight in the position just mentioned to find locations on a road map or along the road, or to illuminate road signs or house numbers.

Moreover, a person can hold the flashlight backward, such in the web between thumb and index finger or between index and middle finger and can then actuate the flashlight with, say, the middle finger or the thumb at the tail-end switch 18. In this manner, the user can shine the light behind his or her person, so as to discourage people that follow him or her too closely.

The flashlight according to the illustrated preferred embodiment of the invention enables a superb performance of the Rodgers technique, as apparent from FIG. 2.

After adapting the flashlight to the hand of the user at 21 to 23 and after adjusting the flashlight to the preferred touch of the user at 28, that user places the reduced or "necked down" portion 20 of the flashlight at barrel 16 between the index finger and middle finger of one hand, preferably right down against the bottom of the web between these two fingers. The user then positions the tail end of the flashlight against the ball of his or her thumb or thumb area 12. The user may initially test the flashlight and adjust it at 21 to 23 and 28, until it has the right feel and touch and will serve well in life threatening situations and confrontations, where the light comes on easily, but not inadvertently.

In this manner the user can work out the right grip, where the flashlight is comfortable and the switching is easily controllable, so that the user neither will be left in the dark when he or she needs light, nor will become a lit target when darkness is preferable in a given situation.

With the lanyard loop 32 around the wrist as in FIG. 2, the user can let the flashlight dangle down while not in use, and can easily swing the flashlight into his or her hand for the desired grip or use. In practice, the user can clench the flashlight in hand 14 and can use such hand to support the hand 36 that holds the weapon 37. For instance, the heel of the support hand 14 may contact the exposed portion of the hand 36, with the tips of the lower two fingers of the support hand 14 contacting the corresponding fingers of the weapon hand 36. In this manner, the flashlight can be adjusted into alignment with the bore of weapon 37.

With practice, the flashlight becomes a very effective tactical adjunct of the weapon.

This extensive disclosure will render apparent or suggest to those skilled in the art various modifications and variations within the spirit and scope of the invention.

I claim:

1. In a method of providing a flashlight including an elongate battery barrel having a front end and a tail end opposite said front end, with a mode of operation enabling switching of said flashlight at a thumb area of a human hand while retaining said flashlight with fingers of said human hand during switching of said flashlight at said thumb area, the improvement comprising in combination:

locating at said front end of said elongate battery barrel a lamp assembly including a lamp and lamp reflector pointing longitudinally away from said elongate battery barrel;

providing said battery barrel at said tail end with a tail-end switch for said flashlight;

providing said battery barrel with a reduced diameter portion spaced from said tail-end switch; and providing said battery barrel with a retention element projecting from said reduced diameter portion beyond a maximum lateral dimension of said barrel for retention of the flashlight between two adjacent ones of said fingers of the human hand during switching of said flashlight at said thumb area.

2. A method as in claim 1, wherein:

said flashlight is made adaptable to various human hand sizes by rendering said retention element adjustable in position on said reduced diameter portion relative to said tail-end switch.

3. A method as in claim 1, wherein:

said flashlight is made adaptable to typical human hand sizes by rendering said retention element adjustable in position on said reduced diameter portion in discrete steps relative to said tail-end switch.

4. A method as in claim 1, wherein:

said battery barrel is provided with a retention shoulder between said reduced diameter portion and said tail-end switch.

5. A method as in claim 4, wherein:

said retention element is retained with said shoulder.

6. A method as in claim 4, wherein:

said retention element extends around said reduced diameter portion and is axially retained in place with said shoulder.

7. A method as in claim 4, wherein:

said flashlight is rendered adaptable to typical human hand sizes by providing said reduced diameter portion with removable spacer elements between said retention element and said shoulder of the battery barrel.

8. A method as in claim 4, wherein:

said flashlight is made adaptable to typical human hand sizes by rendering said retention element adjustable in position on said reduced diameter portion in discrete steps relative to said tail-end switch.

9. A method as in claim 1, wherein:

said reduced diameter portion is adapted to be held between two adjacent fingers of said human hand; and said retention element is adapted to be engaged by said two fingers during switching of said flashlight at said thumb area.

10. A method as in claim 1, wherein:

handling of said flashlight is improved by means of a lanyard attached to said barrel between said reduced diameter portion and said tail-end switch.

11. In a flashlight, the improvement comprising in combination:

an elongate battery barrel having a front end and a tail end opposite said front end;

a lamp assembly located at said front end of said elongate battery barrel and including a lamp and lamp reflector pointing longitudinally away from said elongate battery barrel;

a tail-end switch for said flashlight on said battery barrel at said tail end and electrically connectible to said lamp;

a reduced diameter portion on said battery barrel spaced from said tail-end switch; and a retention element projecting from said reduced diameter portion beyond a maximum lateral dimension of said barrel and adapted for retention of the flashlight between two adjacent fingers of a human hand during switching of said flashlight with said tail-end switch at a thumb area of said human hand.

12. A flashlight as in claim 11, wherein:

said retention element is adapted to be adjustable in position on said reduced diameter portion relative to said tail-end switch.

13. A flashlight as in claim 11, wherein:

said retention element is adapted to be adjustable in position on said reduced diameter portion in discrete steps relative to said tail-end switch.

14. A flashlight as in claim 11, wherein:

said battery barrel has a shoulder between said reduced diameter portion and said tail-end switch.

15. A flashlight as in claim 14, wherein:

said retention element is adapted for retention by said shoulder.

16. A flashlight as in claim 14, wherein:

said retention element extends around said reduced diameter portion and is adapted for axial retention by said shoulder.

17. A flashlight as in claim 14, including:

removable spacer elements between said retention element and said shoulder of the battery barrel.

18. A flashlight as in claim 14, wherein:

said retention element is adapted to be adjustable in position on said reduced diameter portion in discrete steps relative to said tail-end switch.

19. A flashlight as in claim 11, wherein:

said reduced diameter portion is dimensioned for retention between two adjacent fingers of said human hand; and said retention element is adapted to be engaged by said two fingers during switching of said flashlight at said thumb area.

20. A flashlight as in claim 11, including:

a lanyard attached to said barrel between said reduced diameter portion and said tail-end switch.

21. In a method of providing a flashlight including an elongate battery barrel having a front end and a tail end opposite said front end, with a mode of operation enabling switching of said flashlight at a thumb area of a human hand while retaining said flashlight with fingers of said human hand during switching of said flashlight at said thumb area, the improvement comprising in combination:

locating at said front end of said elongate battery barrel a lamp assembly including a lamp and lamp reflector pointing longitudinally away from said elongate battery barrel;

providing said battery barrel at said tail end with a tail-end switch for said flashlight;

providing said battery barrel with a reduced diameter portion spaced from said tail-end switch;

providing said battery barrel with a retention element projecting from said reduced diameter portion beyond a maximum lateral dimension of said barrel for retention of the flashlight between two adjacent ones of said fingers of the human hand during switching of said flashlight at said thumb area; and making said flashlight adaptable to various human hand sizes by rendering said retention element adjustable in position on said reduced diameter portion relative to said tail-end switch.

22. A method as in claim 21, wherein:

said flashlight is made adaptable to typical human hand sizes by rendering said retention element adjustable in position on said reduced diameter portion in discrete steps relative to said tail-end switch.

23. A method as in claim 21, wherein:

said battery barrel is provided with a retention shoulder between said reduced diameter portion and said tail-end switch.

24. A method as in claim 23, wherein:

said retention element is retained with said shoulder.

25. A method as in claim 23, wherein:

said retention element extends around said reduced diameter portion and is axially retained in place with said shoulder.

26. A method as in claim 23, wherein:

said flashlight is rendered adaptable to typical human hand sizes by providing said reduced diameter portion with removable spacer elements between said retention element and said shoulder of the battery barrel.

27. A method as in claim 21, wherein:

said retention element is projected beyond a maximum lateral dimension of said barrel.

28. A method as in claim 21, wherein:

said reduced diameter portion is adapted to be held between two adjacent fingers of said human hand; and said retention element is adapted to be engaged by said two fingers during switching of said flashlight at said thumb area.

29. A method as in claim 21, wherein:

handling of said flashlight is improved by means of a lanyard attached to said barrel between said reduced diameter portion and said tail-end switch.

30. In a method of providing a flashlight including an elongate battery barrel having a front end and a tail end opposite said front end, with a mode of operation enabling switching of said flashlight at a thumb area of a human hand while retaining said flashlight with fingers of said human hand during switching of said flashlight at said thumb area, the improvement comprising in combination:

locating at said front end of said elongate battery barrel a lamp assembly including a lamp and lamp reflector pointing longitudinally away from said elongate battery barrel;

providing said battery barrel at said tail end with a tail-end switch for said flashlight;

providing said battery barrel with a reduced diameter portion spaced from said tail-end switch;

providing said battery barrel with a retention shoulder between said reduced diameter portion and said tail-end switch;

providing said battery barrel with a retention element projecting from said reduced diameter portion for retention of the flashlight between two adjacent ones of said fingers of the human hand during switching of said flashlight at said thumb area; and retaining said retention element with said shoulder.

31. A method as in claim 30, wherein:

said retention element extends around said reduced diameter portion and is axially retained in place with said shoulder.

32. A method as in claim 30, wherein:

said flashlight is rendered adaptable to typical human hand sizes by providing said reduced diameter portion with removable spacer elements between said retention element and said shoulder of the battery barrel.

33. A method as in claim 30, wherein:

said retention element is projected beyond a maximum lateral dimension of said barrel.

34. A method as in claim 30, wherein:

said reduced diameter portion is adapted to be held between two adjacent fingers of said human hand; and said retention element is adapted to be engaged by said two fingers during switching of said flashlight at said thumb area.

35. In a flashlight, the improvement comprising in combination:

an elongate battery barrel having a front end and a tail end opposite said front end;

a lamp assembly located at said front end of said elongate battery barrel and including a lamp and lamp reflector pointing longitudinally away from said elongate battery barrel;

a tail-end switch for said flashlight on said battery barrel at said tail end and electrically connectible to said lamp;

a reduced diameter portion on said battery barrel spaced from said tail-end switch; and a retention element projecting from said reduced diameter portion and adapted for retention of the flashlight between two adjacent fingers of a human hand during switching of said flashlight with said tail-end switch at a thumb area of said human hand;

said retention element adapted to be adjustable in position on said reduced diameter portion relative to said tail-end switch.

36. A flashlight as in claim 35, wherein:

said retention element is adapted to be adjustable in position on said reduced diameter portion in discrete steps relative to said tail-end switch.

37. A flashlight as in claim 35, wherein:

said battery barrel has a shoulder between said reduced diameter portion and said tail-end switch.

38. A flashlight as in claim 37, wherein:

said retention element is adapted for retention by said shoulder.

39. A flashlight as in claim 37, wherein:

said retention element extends around said reduced diameter portion and is adapted for axial retention by said shoulder.

40. A flashlight as in claim 37, including:

removable spacer elements between said retention element and said shoulder of the battery barrel.

41. A flashlight as in claim 35, wherein:

said retention element projects beyond a maximum lateral dimension of said barrel.

42. A flashlight as in claim 35, wherein:

said reduced diameter portion is dimensioned for retention between two adjacent fingers of said human hand; and said retention element is adapted to be engaged by said two fingers during switching of said flashlight at said thumb area.

43. A flashlight as in claim 35, including:

a lanyard attached to said barrel between said reduced diameter portion and said tail-end switch.

44. In a flashlight, the improvement comprising in combination:

an elongate battery barrel having a front end and a tail end opposite said front end;

a lamp assembly located at said front end of said elongate battery barrel and including a lamp and lamp reflector pointing longitudinally away from said elongate battery barrel;

a tail-end switch for said flashlight on said battery barrel at said tail end and electrically connectible to said lamp;

a reduced diameter portion on said battery barrel spaced from said tail-end switch;

a shoulder on said battery barrel between said reduced diameter portion and said tail-end switch; and a retention element projecting from said reduced diameter portion and adapted for retention of the flashlight between two adjacent fingers of a human hand during switching of said flashlight with said tail-end switch at a thumb area of said human hand;

said retention element adapted for retention by said shoulder.

45. A flashlight as in claim 44, wherein:

said retention element extends around said reduced diameter portion and is adapted for axial retention by said shoulder.

46. A flashlight as in claim 44, including:

removable spacer elements between said retention element and said shoulder of the battery barrel.

47. A flashlight as in claim 44, wherein:

said retention element projects beyond a maximum lateral dimension of said barrel.

48. A flashlight as in claim 44, wherein:

said reduced diameter portion is dimensioned for retention between two adjacent fingers of said human hand; and said retention element is adapted to be engaged by said two fingers during switching of said flashlight at said thumb area.

49. A flashlight as in claim 44, including:

a lanyard attached to said barrel between said reduced diameter portion and said tail-end switch.

50. In a flashlight, the improvement comprising in combination:

an elongate battery barrel having a front end and a tail end opposite said front end;

a lamp assembly located at said front end of said elongate battery barrel and including a lamp and lamp reflector pointing longitudinally away from said elongate battery barrel;

a tail-end switch for said flashlight on said battery barrel at said tail end and electrically connectible to said lamp;

a reduced diameter portion on said battery barrel spaced from said tail-end switch and having in an axial direction of said barrel a length at least equal to the width of a finger of a human hand, for retention of said reduced diameter portion between two adjacent fingers of said human hand; and a retention element projecting from said reduced diameter portion and adapted for retention of the flashlight between said two fingers during switching of said flashlight with said tail-end switch at a thumb area of said human hand.

51. A flashlight as in claim 50, wherein:

said retention element extends substantially perpendicularly to said reduced diameter portion between said reduced diameter portion and said tail-end switch.

* * * * *